US010466013B2

(12) United States Patent
Smith et al.

(10) Patent No.: US 10,466,013 B2
(45) Date of Patent: Nov. 5, 2019

(54) HYPER HEMISPHERE UNITARY DOME FOR A DEFENSIVE INFRARED COUNTERMEASURE SYSTEM

(71) Applicant: BAE Systems Information and Electronic Systems Integration Inc., Nashua, NH (US)

(72) Inventors: Donald K. Smith, Rye, NH (US); Michael J. Powers, Amherst, NH (US); Mark T. Biggie, Milford, NH (US); Greg L. Johnson, Manchester, NH (US)

(73) Assignee: BAE Systems Information and Electronic Sytems Integration Inc., Nashua, NH (US)

( * ) Notice: Subject to any disclaimer, the term of this patent is extended or adjusted under 35 U.S.C. 154(b) by 195 days.

(21) Appl. No.: 15/527,441

(22) PCT Filed: Nov. 16, 2015

(86) PCT No.: PCT/US2015/060898
§ 371 (c)(1),
(2) Date: May 17, 2017

(87) PCT Pub. No.: WO2016/122753
PCT Pub. Date: Aug. 4, 2016

(65) Prior Publication Data

US 2017/0356721 A1 Dec. 14, 2017

Related U.S. Application Data

(60) Provisional application No. 62/080,702, filed on Nov. 17, 2014.

(51) Int. Cl.

| | |
|---|---|
| ***F42B 15/01*** | (2006.01) |
| ***F41G 7/22*** | (2006.01) |
| ***F41H 13/00*** | (2006.01) |

(52) U.S. Cl.
CPC ..... *F41G 7/224* (2013.01); *F41H 13/0056* (2013.01)

(58) Field of Classification Search
CPC ..... F41G 7/224
(Continued)

(56) References Cited

U.S. PATENT DOCUMENTS 2,206,065 A 7/1940 Trimbach et al.
2,941,082 A * 6/1960 Carbonara ..... G01S 3/782 244/3.18

(Continued)

FOREIGN PATENT DOCUMENTS

CN 201518510 6/2010

OTHER PUBLICATIONS

International Search Report for PCT/US2015/060898, dated Jul. 26, 2016, 20 pages.

*Primary Examiner* — Reginald S Tillman, Jr.
(74) *Attorney, Agent, or Firm* — Sand, Sebolt & Wernow LPA; Scott J. Asmus

(57) ABSTRACT

A counter measure system is provided having a unitary infrared transparent dome including a look angle greater than 180. The dome has two hemispherical regions, with a second region having a truncated bottom end defining an opening to a central cavity inside which electro-optical elements are disposed. The electro-optical elements can view outward through the dome at the look angle. The second region on the dome has a complementary curvature as the first region by continuing a similar radius beyond a transverse horizontal axis or equator. The dome is mounted to a base, which also may be referred to as a bezel. The base defines a rabbet extending circumferentially about the base imaginary center defining an aperture. The base and the dome are formed from different materials but have equiva- (Continued)

lent coefficients of thermal expansion. In one embodiment the dome if formed from sapphire and the base is titanium.

9 Claims, 6 Drawing Sheets

(58) Field of Classification Search
USPC ..... 244/3.16; 396/427
See application file for complete search history.

(56) References Cited

U.S. PATENT DOCUMENTS

| | | | | |
|---|---|---|---|---|
| 3,974,985 | A * | 8/1976 | Campbell | F41G 7/2213 244/3.16 |
| 4,337,105 | A * | 6/1982 | Stachiw | B29C 37/006 100/211 |
| 5,600,434 | A | 2/1997 | Warm et al. | |
| 6,873,893 | B1 | 3/2005 | Sanghera et al. | |
| 6,929,214 | B2 * | 8/2005 | Ackleson | B64D 7/00 244/1 R |
| 7,306,383 | B2 | 12/2007 | Jones et al. | |
| 7,336,407 | B1 * | 2/2008 | Adams | G01S 7/495 359/211.1 |
| 7,378,626 | B2 | 5/2008 | Fetterly | |
| 7,670,685 | B2 | 3/2010 | Bayya et al. | |
| 8,140,200 | B2 | 3/2012 | Heppe et al. | |
| 2003/0098387 | A1 * | 5/2003 | Baumann | F41G 7/2213 244/3.13 |
| 2009/0260511 | A1 | 10/2009 | Melnychuk et al. | |
| 2013/0337993 | A1 | 12/2013 | Lee et al. | |

* cited by examiner

HYPER HEMISPHERE UNITARY DOME FOR A DEFENSIVE INFRARED COUNTERMEASURE SYSTEM

CROSS-REFERENCE TO RELATED APPLICATIONS

This Application claims priority to U.S. PCT Application Serial. No. PCT/US2015/060898 filed Nov. 16, 2015 which claims the benefit of U.S. Provisional Application Ser. No. 62/080,702 filed Nov. 17, 2014, the contents of which are incorporated herein by reference.

BACKGROUND

Technical Field

The present disclosure relates generally to the field of defensive common infrared counter measure systems. More particularly, the present disclosure relates to defensive infrared systems having an electro-optical system disposed within protective dome on an aircraft. Specifically, the present disclosure relates to a hyper hemispherical dome on an infrared countermeasure system having a look angle greater than 180 degrees to allow two cooperating countermeasure systems mounted to an aircraft to fully observe incoming threats rather than prior art systems that require at least three counter measure systems.

Background Information

Infrared Countermeasures (IRCM) are infrared guidance systems configured to track strong sources of infrared radiation, namely heat, from aircraft engines. This helps missiles to hone in on their targets. IRCM systems have a modulated source of infrared radiation with a higher intensity than that of the target. When a missile seeker observes this modulated radiation, it interferes with or obscures the modulated signal from the aircraft and renders the missile incapable of maintaining a lock on the target.

Directional IRCM, or DIRCM, has a countermeasure laser to directly target an incoming IR threat. This makes a more powerful and effective defense than previous, non-directional infrared countermeasures, as the threat is directly addressed rather than the system essentially painting an area with IR disruption, which results in a weaker signal in any given direction.

Generally, airborne infrared (IR) countermeasure systems are required to defeat missile threats over a full spherical coverage range of 360 degrees. To defeat advanced threats high powered laser systems are required that are directed on the threat by advanced gimbals. Threats can come from any direction and thus gimbals are required to quickly and accurately move to the threat location. For these gimbals to work they need to be protected in sealed housings and must look through advanced windows that operate with maximum optical transmission and quality in the infrared spectrum. These windows will see harsh environments which limits window materials and configurations. Existing infrared window technologies are flat windows or domes that limit coverage to less than 180 degrees requiring more than two gimbals to provide 360 degrees coverage. Bonded hyper-hemispherical domes made of multiple pieces can be fabricated but bonded seams interfere with countermeasure performance.

As IR seeking technology has improved and diversified, standard IRCM systems have become less effective at defeating heat-seeking missiles. Measures such as flares have begun to give way to lasers, which, when fitted on a directional pivoting mount, allow for more effective, concentrated and energy-efficient directional targeting of IR radiation at incoming missile seekers.

In an effort to continue advancement of DIRCM technology, the United States Department of Defense (DoD) instituted a program called the Common Infrared Countermeasures program (CIRCM). CIRCM intended for defense contractors to develop a lightweight, low-cost and modular laser-based infrared protection system for U.S. helicopters and light fixed-wing aircraft. The CIRCM technology will provide defense against shoulder-fired, heat-seeking missiles, or MANPADS. The CIRCM program replaces older legacy systems such as the Advanced Threat Infrared Countermeasures (ATIRCM).

The CIRCM system meets Tri-Service "common" Army, Navy, and Air Force requirements. The DoD's strategy is to competitively develop a lightweight and cost-effective jammer subsystem for installation on all DoD rotary-wing and slow moving fixed-wing aircraft.

One government contractor, recently published their device for the CIRCM program. This contractor's device uses a compact ECLIPSE pointer/tracker, a COTS processor and Quantum Cascade Laser (QCL). The ECLIPSE pointer/tracker is available for public inspection at http://www.northropgrumman.com/Capabilities/CIRCM/Documents/CIRCMdatasheet.pdf.

A review of this contractor's CIRCM ECLIPSE pointer/tracker discloses a modular unit having a hemispherical dome housing electro-optical (EO) elements therein intended to provide defensive measures meeting the needs of the CIRCM. Particularly, the hemispherical dome appears to be a less than 180 degree dome (exact half a sphere, also referred to as a hemisphere) extending upward from a modular housing. A less than 180 degree infrared (IR) dome is easily fabricated.

SUMMARY

Although IR domes for housing EO elements are easily fabricated, they are not without risk and thus, issues exist within CIRCM defensive systems utilizing a less than 180 degree hemispherical dome. Particularly, the less than 180 degree IR domes cannot "look" beyond their physical less than 180 degree limitations. Thus, to provide sufficient defensive coverage on an aircraft, at least three CIRCM systems having less than 180 degree IR domes would need to be installed on the aircraft to properly "look for" and "see" incoming threats/missiles. This is because two less than 180 degree IR domes still leave a seam line or blind spot of their aligned viewing capabilities. Additionally, a need exists for an infrared dome that provides greater than 180 degree coverage fabricated from durable infrared materials such as sapphire and ALON, since fabrication of a single piece hyper-hemispherical dome is challenging with both ALON and sapphire. The present disclosure address these and other issues. Further, the present disclosure presents one aspect of BAE Systems' solution to address the DoD's needs outlined in the CIRCM program.

In one aspect, an embodiment of the disclosure may provide an infrared countermeasures system including a single piece hyper-hemispherical dome with a greater than 200 degree field of use.

In another aspect, an embodiment of the disclosure may provide a unitary transparent dome comprising: a hemispherical first region spanning 180 degrees in cross section; a truncated-hemispherical second region aligned with and having complementary arcuate geometry and radius as the first region, the truncated-hemispherical second region terminating at a bottom edge; a central angle associated with the second region in cross section in a range from about 5 degrees to about 30 degrees; an overall dome look angle equal to the sum of the 180 degree span of the first region and the central angle associated with the second region; and a continuous convexly curved outer surface exterior to and spaced apart from a continuous concavely curved inner surface; wherein the unitary transparent dome is free of any optical hindrances where the first region aligns with the second region. This embodiment may further include wherein the bottom edge is circularly shaped and defines an entrance opening to a cavity formed by the inner surface. This embodiment may further include a lower end of the inner surface adjacent the bottom edge; and a vertically extending first planar wall extending downward from the lower end. This embodiment may further include a lower end of the outer surface adjacent the bottom edge; and a transversely extending second planar wall extending from the lower end of the outer surface to the vertically extending first planar wall; wherein the bottom edge is located where the first planar wall adjoins the second planar wall. This embodiment may further include an angle in cross section interior formed between the second planar wall and the outer surface, wherein the interior angle is at least 90 degrees; or an interior angle in cross section formed between the first planar wall and the second planar wall, wherein the interior angle is at least 90 degrees; or an interior angle in cross section formed between the first planar wall and the inner surface, wherein the interior is at least 90 degrees. This embodiment may further include an imaginary directly vertical plane tangent to the convex inner surface in cross section; and wherein, when viewed in cross section, the bottom edge is interior the vertical plane relative to the dome center. This embodiment may further include wherein the dome is fabricated from one of the following: sapphire and ALON. This embodiment may further include an outer diameter measured along a central plane in a range from about 3 inches to about 7 inches.

In another aspect, another aspect of the disclosure may provide a defensive infrared counter measure system comprising: a flying device; a replaceable module coupled with the flying device; a dome base mounted to the replaceable module; a hyper-hemispherical dome having a look angle greater than 180 degrees, the dome defining an internal cavity, wherein the dome includes a truncated-hemispherical region extending from a central plane to arcuate bottom edge, wherein the edge defines an opening to the cavity; the arcuate bottom edge coupled with the dome base thereby attaching the hyper-hemispherical dome to the dome base; and an electro-optical system carried by the module and disposed, at least partially, in the internal cavity and adapted to view outward from the flying device at the look angle.

In another aspect, an embodiment may provide a method of defending a flying device comprising the steps of: providing a first unitary infrared (IR) transparent dome on the flying device, the first unitary IR transparent dome including a hemispherical first region spanning 180 degrees in cross section, a truncated-hemispherical second region aligned with and having complementary arcuate geometry and radius as the first region, the truncated-hemispherical second region terminating at a bottom edge, a central angle associated with the second region in cross section, and the central angle in a range from about 5 degrees to about 35 degrees, a dome look angle equal to the sum of the 180 degree span of the first region and the central angle associated with the second region, and a continuous convexly curved outer surface exterior to and spaced apart from a continuous concavely curved inner surface; wherein the unitary transparent dome is single piece of material free of any optical hindrances where the first region aligns with the second region; wherein the first unitary IR transparent dome faces a first direction; providing a second unitary IR transparent dome, identical to the first, on the flying device a facing a second direction opposite the first direction; and observing a 360° view around the flying device with only the first and second unitary IR transparent domes.

In another aspect, an embodiment of the disclosure may provide a hyper-hemispherical dome having a look angle greater than 180 degrees, the dome defining an internal cavity, wherein the dome includes a truncated-hemispherical region extending from a central plane to arcuate bottom edge, wherein the edge defines an opening to the cavity.

In yet another aspect, an embodiment of the disclosure may provide a counter measure system having a unitary infrared transparent dome including a look angle greater than 180°. The dome has two hemispherical regions, with a second region having a truncated bottom end defining an opening to a central cavity inside which electro-optical elements are disposed. The electro-optical elements can view outward through the dome at the look angle. The second region on the dome has a complementary curvature as the first region by continuing a similar radius beyond a transverse horizontal axis or equator. The dome is mounted to a base, which also may be referred to as a bezel. The base defines a rabbet extending circumferentially about the base imaginary center defining an aperture. The base and the dome are formed from different materials but have equivalent coefficients of thermal expansion. In one embodiment the dome if formed from sapphire and the base is titanium.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
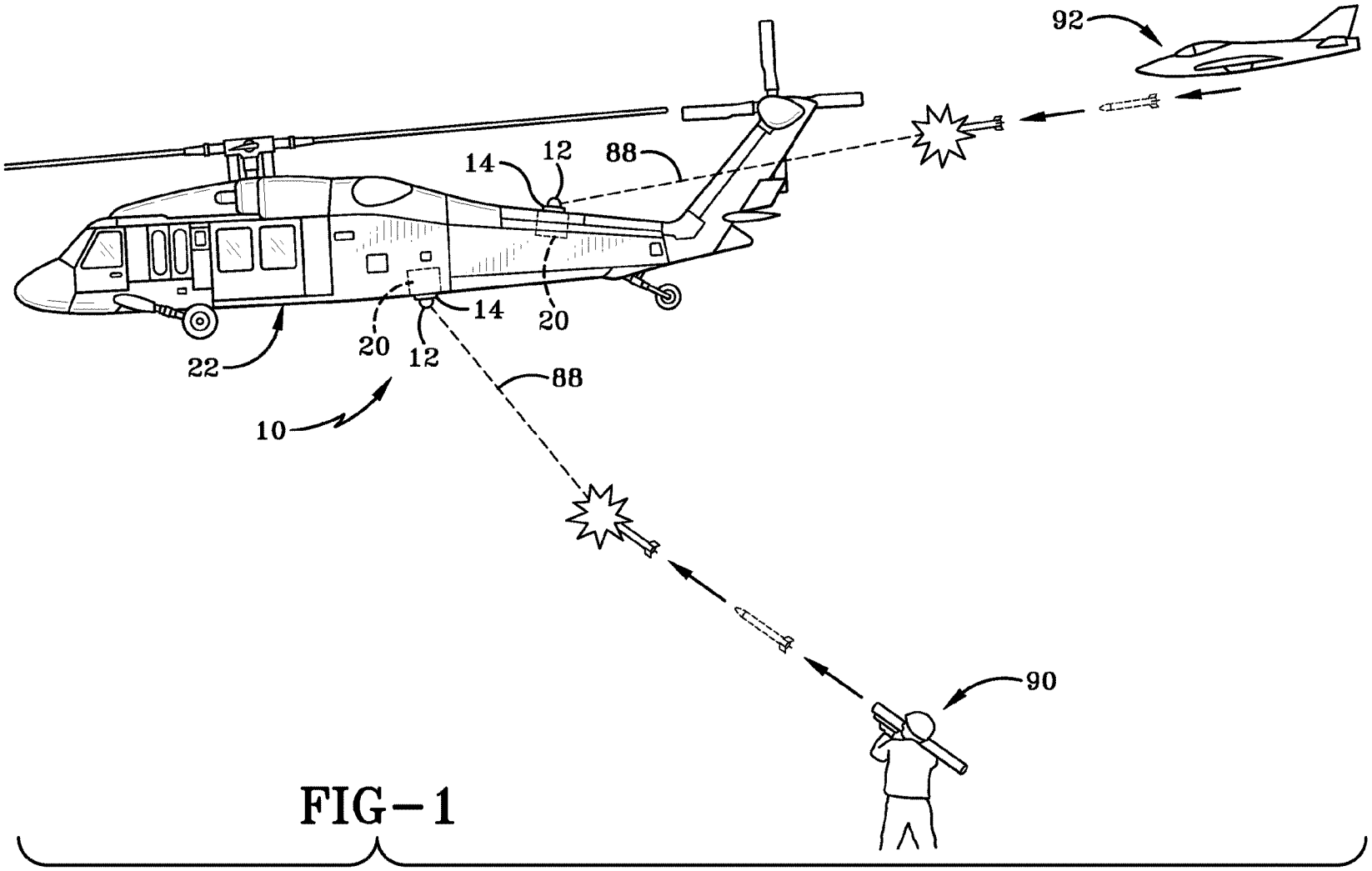
FIG. 1 is an exemplary environmental schematic view of a hyper hemisphere unitary dome for a defensive infrared countermeasure system.

A counter measure system is depicted generally throughout FIG. 1 through FIG. 7 and is generally illustrated as 10. Counter measure system 10 may include a unitary infrared (IR) transparent dome 12, a dome base 14, a coupling member 16 attaching dome 12 to base 14, an electro-optical (EO) system 18, and a modular unit or module 20.

As depicted in FIG. 1, counter measure system 10 is shown as being implemented in association with an aircraft or other flying device 22. Aircraft 22 is depicted as a helicopter but may be any other form of flying device as one having ordinary skill in the art would understand. By way of brief introduction, counter measure system 10 eliminates threats such as missiles fired from airborne aggressors or launched from the ground. Further descriptions of the operation of counter measure system 10 with aircraft 22 will be described in greater detail below.

Figure 2:
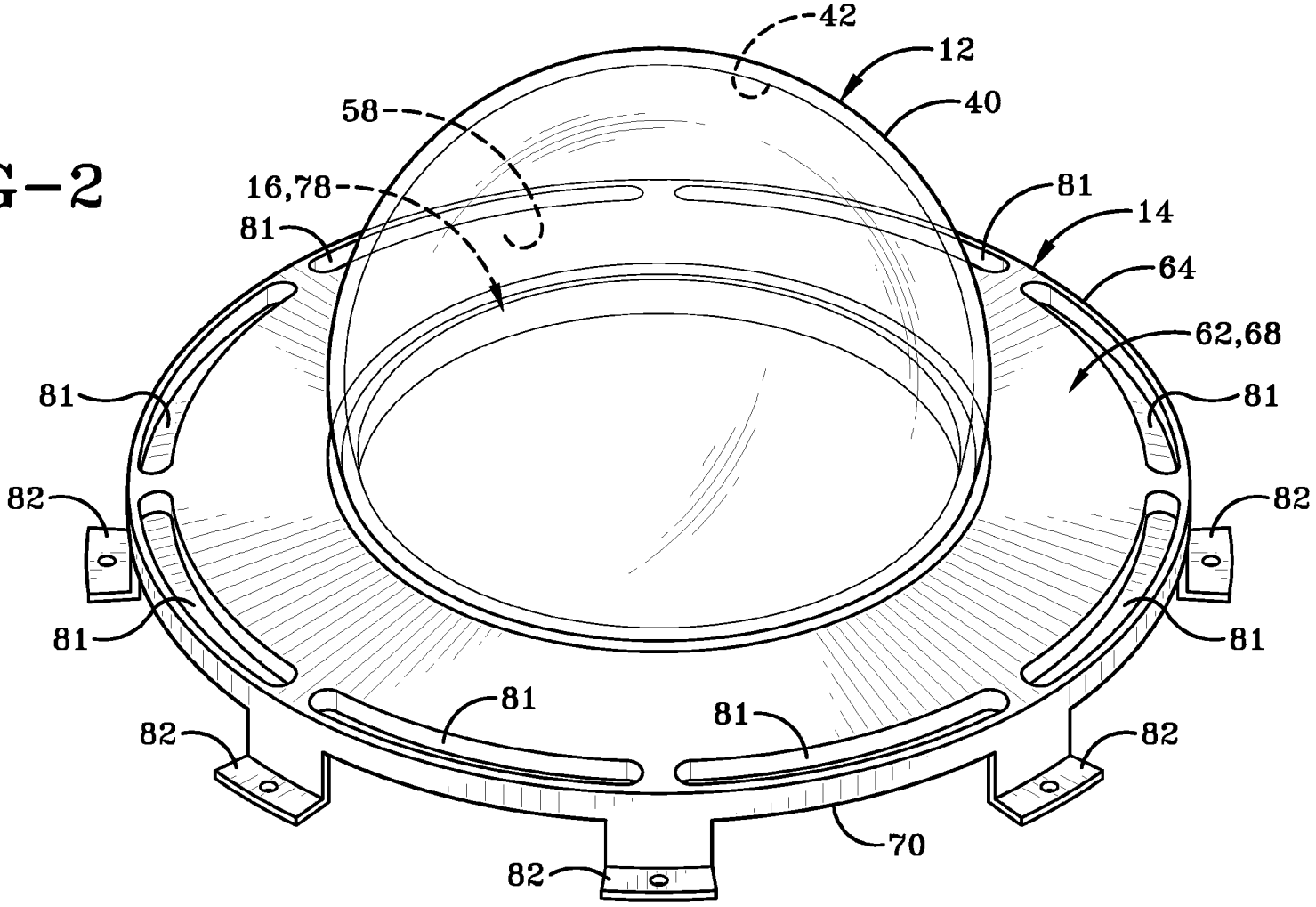
FIG. 2 is a top perspective view of the dome mounted on a bezel or base.
Figure 3:
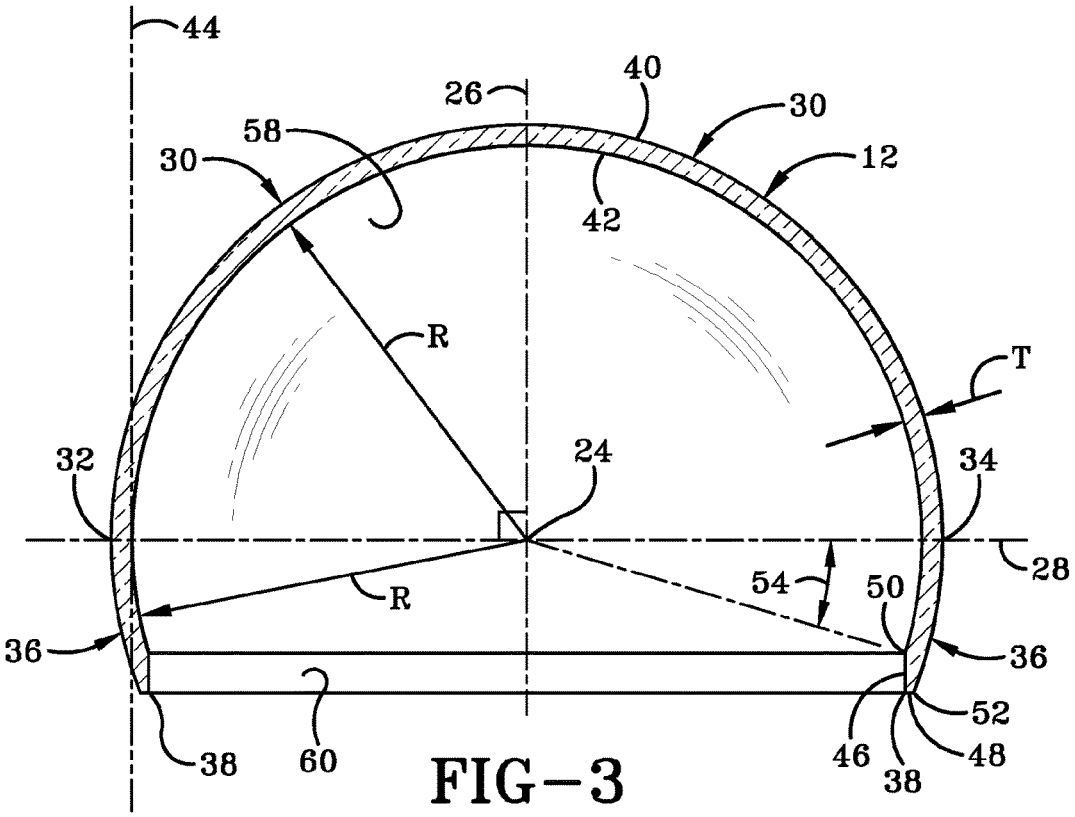
FIG. 3 is a longitudinal cross-section view of the dome.

As depicted in FIG. 2 and FIG. 3, dome 12 includes a center 24 at which an imaginary vertical axis 26 perpendicularly intersects an imaginary transverse axis 28. A first hemispherical region 30 is in the shape of a right angle hemisphere spanning 180° above transverse axis 28 from a first equator point 32 to a second equator point 34 diametrically opposite the first equator point 32.

A truncated second hemispherical region 36 is aligned with first hemispherical region 30 and has a complementary geometry therewith following the same radius of curvature R about center 24. Second hemispherical region 36 extends from transverse axis 28 to a bottom edge 38.

Dome 12 includes a convexly curved outer surface 40 facing radially away from center 24 and a concavely curved inner surface 42 facing radially towards center 24. A thickness distance T represents the thickness of the dome and extends from inner surface 42 to outer surface 40.

An imaginary vertical plane 44 is tangent to inner surface 42 at a first equator point 32 along transverse axis 28. Imaginary plane 44 is perpendicular to transverse axis 28 and is parallel and offset to vertical axis 26. When viewed in cross-section, as depicted in FIG. 3, the bottom edge 38 of second truncated hemisphere region 36 is radially inward, or interior, or closer to, center 24 than imaginary plane 44. This is because the radius R of second hemispherical region 36 is equal to that of radius R of first hemisphere region 30.

First hemisphere region 30 aligns with second truncated hemisphere region 36 at transverse axis 28. For the purposes of this disclosure, different regions of the dome are being described for clarity purposes. However, it is to be clearly understood that dome 12 is a unitary member fabricated from a single piece of material having a uniform composition along its entire thickness T such that there is no optical hindrances, obstructions, or seams at the location where first hemispherical region 30 aligns with second truncated hemispherical region 36. In one particular embodiment, the dome 12 may be fabricated from sapphire and in another particular embodiment, the dome 12 may be fabricated from Aluminum Oxynitride (ALON). ALON® is an transparent advanced ceramic that is polycrystalline (made from powder) with a cubic spinel crystal structure. Surmet Corporation of Burlington, Mass. manufactures ALON®.

Regarding dimensions, dome 12 has an outer diameter in one particular embodiment of five inches measured from outer surface 40 through center 24. Dome 12 has a thickness T in one particular embodiment of about 0.125 inches. However, this is clearly non-limiting and the dome thickness can be thicker if the outer diameter of the dome is increased, or the thickness may be reduced if the outer diameter is decreased. In each instance, the thickness T of dome 12 remains uniform for each embodiment. The inner diameter of dome 12 measured from inner surface 42 through center 24 in one particular embodiment is about 4.75 inches. Dome 12 has a surface finish of 120 Root Mean Square (RMS), which is a measurement of surface roughness average, for both the outer surface 40 and the inner surface 42. Clearly, this roughness is non-limiting and other roughness averages may be possible to fit other applications. Dome 12 has a transmitted wave front error of 0.158 waves RMS at 633 nm. During tests, dome 12 has a pressure test proof load of 27.8 pounds per square inch (PSI) absolute. Dome 12 is configured to operate in an operating temperature range from about −54° C. to about 85° C. Dome 12 has a non-operating temperature range from about −65° C. to about 95° C.

Reference is now made in more detail to the general area near bottom edge 38. The radially inwardly facing concave inner surface 42 ends at a lower point 50. A first vertical flat wall in cross-section extends vertically downward from point 50 to bottom edge 38. An angle $\alpha 1$ is interior the thickness T of dome 12 and extends between inner surface 42 and vertical wall 46. In one particular embodiment, interior angle $\alpha 1$ is at least 90° and is preferably greater than about 135°.

Outer convex surface 40 terminates at a low point 52. Point 52 on outer surface 40 is lower than point 50 in inner surface 42. A transverse wall 48 extends between low point 52 and a lower most portion of vertical wall 46. The point where vertical wall 46 adjoins transverse wall 48 defines bottom edge 38. Bottom edge is generally circular in shape when viewed from below. In the shown embodiment, an interior second angle $\alpha 2$ extends interior dome 12 between vertical wall 46 and transverse wall 48 and is shown as at least 90°. In FIG. 3, $\alpha 2$ is 90°. A third interior angle $\alpha 3$ extends between transverse wall 48 and outer surface 40 and is generally at least 90° and in the shown embodiment is depicted as greater than about 120°.

A central angle 54 is associated with the second truncated hemispherical region 36 and is measured between the transverse axis 28 to lower end, or low point, 50 on inner surface 42. The central angle associated with second region 36 may be in a range from about 5° to about 35°. More particularly, the range of central angle 54 may be from about 5° to about 15°. Specifically, in one particular embodiment, the central angle 54 is 10°.

An overall dome look angle 56 (FIG. 5) is equal to the sum of the central angle or spanning angle of the first hemisphere region 30 which is 180° plus the central angle 54 associated with second truncated hemispherical region 36. At all times, the dome look angle 56 is greater than 180°. If the central angle 54 is 5°, then the overall dome look angle 56 is 190°. This 190° dome look angle 56 is found by adding 180° from the first hemisphere, plus the 5° central angle offset to the right side of central vertical axis 26 in cross-section, and adding the 5° look angle complementary on the left side of central axis 26 for a total of 190° (180° plus 5° plus 5° equals 190°). In one particular embodiment, the dome look angle is equal to 200°. In this instance, the 180° span of the first hemisphere region 30 is added with a 10° central angle 54. Thus, the 200° overall dome look angle is equal to the central angle 54 10° offset to the right side of vertical axis 26, and a central angle 54 of 10° offset to the left side of vertical axis 26, plus the 180° span of first hemisphere region 30 to create a 200° look angle 56 (180° plus 10° plus 10° equals 200°).

The inner surface 42 of dome 12 defines an internal cavity 58. As will be described in greater detail below, internal cavity 58 is configured to receive EO system 18 therein. Bottom edge 38 and vertical first wall 46 define an entrance opening 60 in communication with internal cavity 58. As will be described in greater detail below, certain components of EO system 18 and coupling member 16 extend through opening 60. Opening 60 has a diameter, in one particular embodiment, of 4.55 inches measured from vertical first wall 46 through central vertical axis 26 to wall 46 on the other side of the dome.

Figure 4:
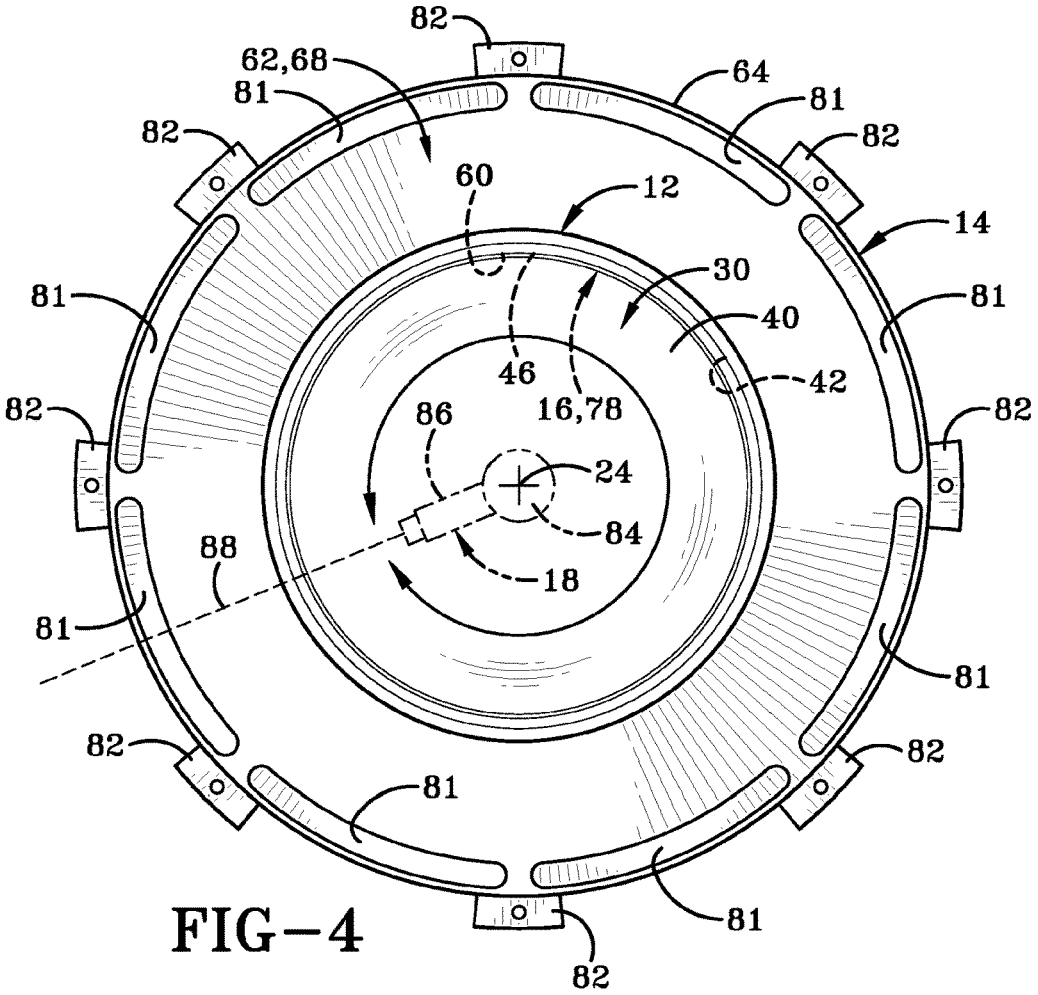
FIG. 4 is a top plan view of the dome mounted to the base.
Figure 5:
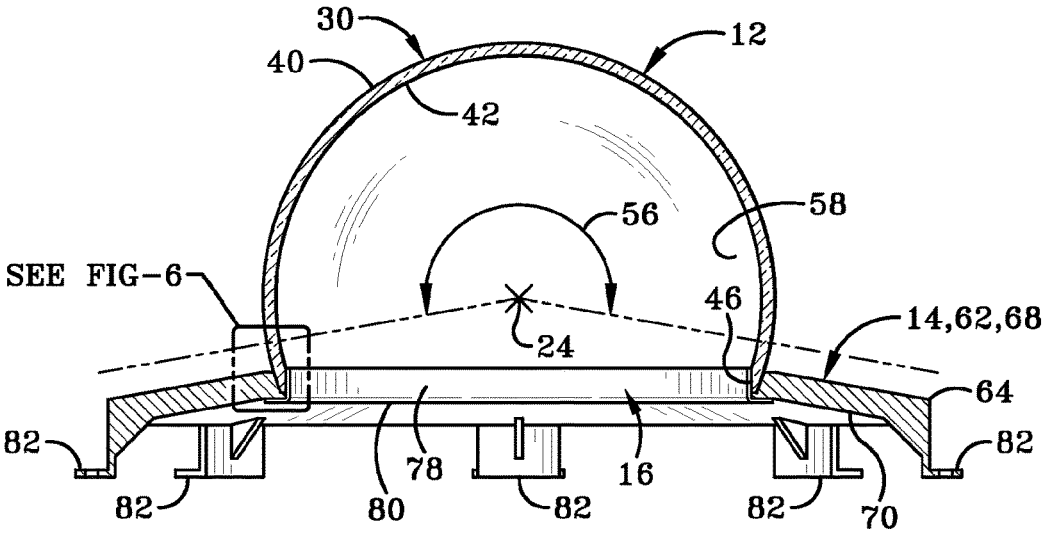
FIG. 5 is a longitudinal cross-section view taken through the center of the dome mounted to the base.

As depicted in FIG. 2, FIG. 4, and FIG. 5, base 14 includes a generally annular member 62 having an outer edge 64 and an inner edge 66. Base 14 may also be referred to as a mounting bezel. An upwardly facing top surface 68 opposes a downwardly facing bottom surface 70, each extending between inner edge 66 and outer edge 64. As can be seen more clearly in FIG. 5, top surface 68 is angled and slopes in a linear fashion outwardly away from center 24 at an angle parallel and offset to central angle 54. Near inner edge 66, a rabbet 72 provides a step shaped cut-out configured to receive bottom edge 38 of dome 12 thereon. Rabbet 72 is defined by an angled vertical wall 74 and a transverse horizontal bottom wall 76. The angle or slope of vertical wall 74 may also be formed in an arcuate manner such as to complement the curvature of outer surface 40 on dome 12. Similarly, transverse wall 76 of rabbet 72 is sized to complement transverse second wall 48 of dome 12 such that they align flushly vertical when dome 12 is received in rabbet 72.

Figure 6:
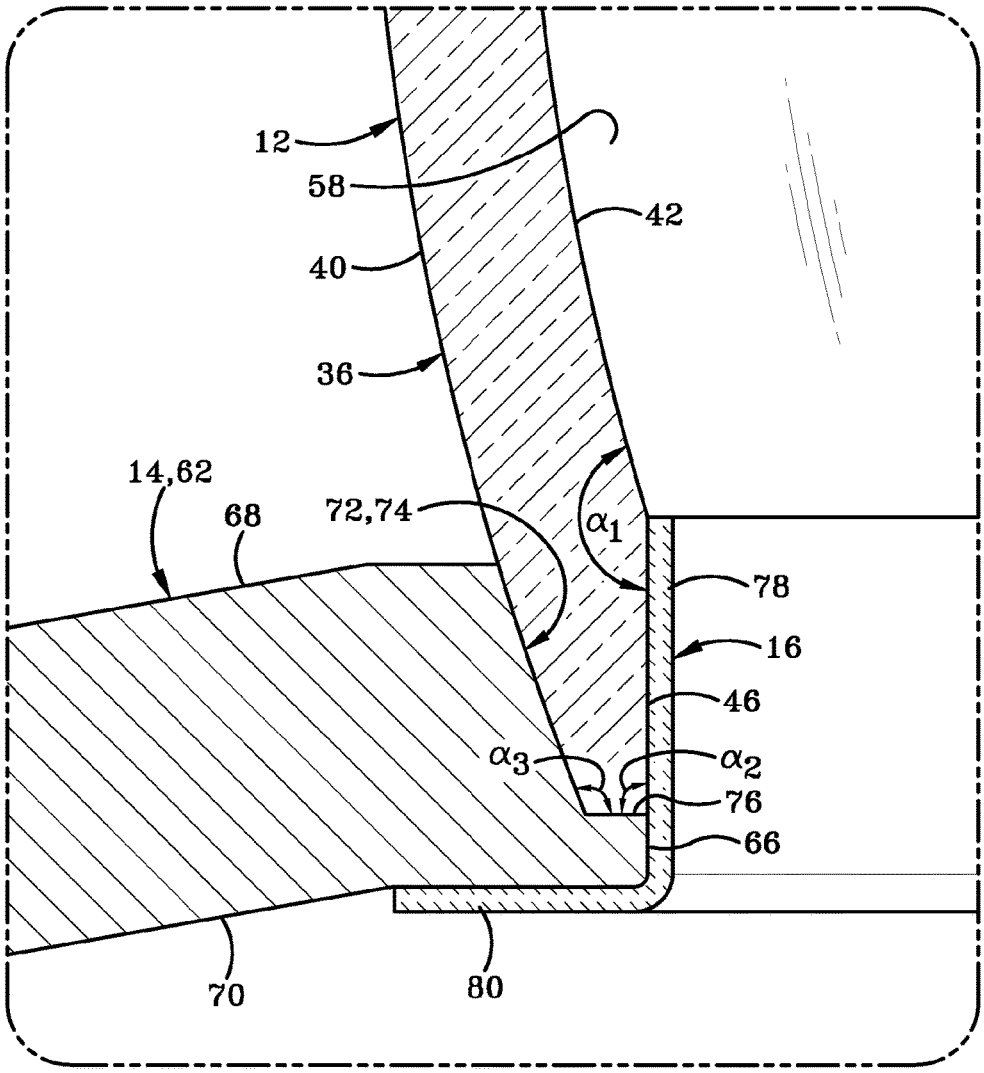
FIG. 6 is an enlarged cross-section view of the callout box labeled as "SEE FIG. 6" in FIG. 5.
Figure 7:
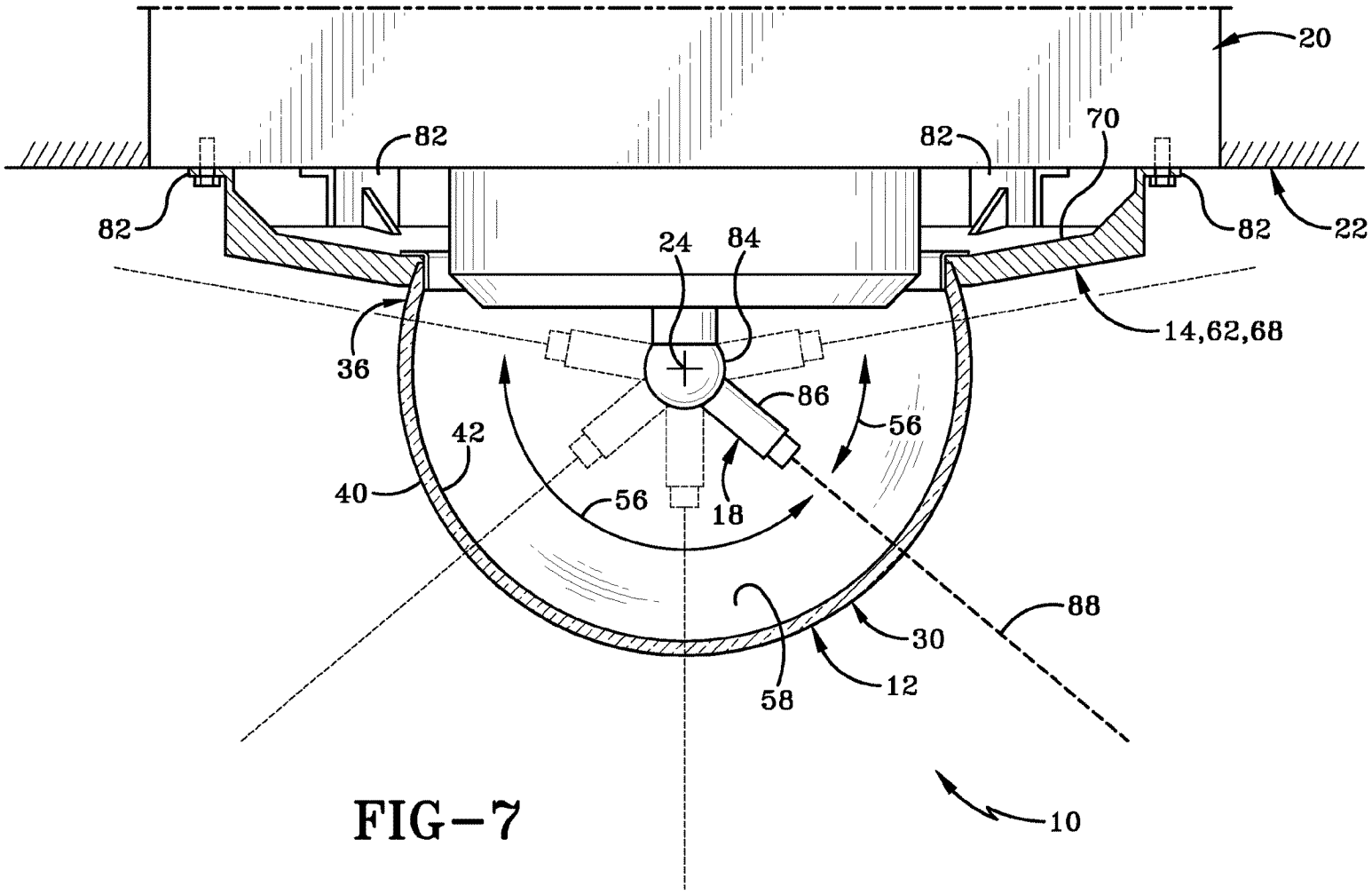
FIG. 7 is a partial side cross-section view of the dome mounted to the bezel or base coupled with a modular unit mounted to a flying device and an electro-optical system observing along a look angle greater than 180 degrees.

As depicted in FIG. 6, coupling member 16 is an annular member having an L-shaped configuration in cross-section including a generally vertical first leg 78 and a horizontal transverse second leg 80. Another portion of vertical leg 78 of coupling member 16 includes an outer surface lying flush with first wall 46 and inner edge 66. Second horizontal leg 80 of coupling member 16 extends under and lies beneath bottom surface 70 of base 14. In one particular embodiment, coupling member 16 is a strip of bent adhesive configured to secure dome 12 to base 14. In another particular embodiment, coupling member 16 may be a rigid ring-like member configured to snap or press fit through frictional interference to couple dome 12 to base 14. A portion of coupling member 16, herein shown as the vertical leg 78, extends through opening 60 generally towards internal cavity 58. In some instances, where coupling member 16 is rigid ring-like member, an adhesive may exist between coupling member 16, dome 12, and base 14. One exemplary adhesive that may be used to join coupling member 16 with dome 12 and base 14 is a silicon rubber adhesive compound for low temperature bonding, encapsulating, and sealing. One exemplary adhesive commercially available for sale under model name "RTV560" is sold by Momentive Performance Materials Inc. of Waterford, N.Y.

Base 14 may further include downwardly extending flexure tabs 82 adjacent outer edge 64 adapted to receive an attachment member such as a screw therethrough to mount base 14 to module 20. Flexure tabs 82 are designed to flex and allow the bezel or base 14 to protect dome 12 from stresses due to thermal expansion in rapidly changing temperature environments such as during flight. Base 14 defines a plurality of semi-arcuate cutouts or channels 81 extending circumferentially about bezel or base 14. Channels 81 also assist with the protection from stresses observed during changes in pressure or temperature during flight. Base 14 is primarily fabricated from a material different than that of dome 12. One exemplary material base 14 may be fabricated from is titanium. However, although dome 12 and base 14 are fabricated from different materials, each has a coefficient of thermal expansion. The coefficient of thermal expansion of each respective material should be equal to the other. For example, dome 12 may be fabricated from sapphire material and base 14 may be fabricated from titanium which are different materials. However, each has a coefficient of thermal expansion that is equal such that when the base is coupled to the dome via coupling member 16, and introduced in high altitude situations of varying temperature and pressure, the base and dome expand and contract relative to one another at the same rate producing a net zero effect so no gaps are formed where the two pieces are connected.

Having described the elements and components of system 10, reference is now made to its advantages through description of its fabrication and operational use.

In accordance with one aspect of an embodiment of the present disclosure, counter measure system 10 provides an improved CIRCM system overcoming some deficiencies of other presently known devices. For example, system 10 provides a counter measure system having a look angle 56 greater than 180° which is clearly advantageous when mounted on a flying device 22 such as a helicopter to provide better laser jamming capabilities.

In accordance with another aspect of an embodiment of the present disclosure, countermeasure system 10, particularly dome 12, provides a greater than 180° optical field of view for the countermeasure gimbal to look below the horizon and cover all threat potentials. The dome 12 is a single piece of material with no seams that would interfere with countermeasure performance. Additionally, the dome can be made from materials that meet infrared performance requirements and be able to withstand harsh environmental conditions. Additionally, countermeasure system 10 may include a mounting bezel or base 14 that is able to adapt to any countermeasure system currently in the market.

Prior to assembling system 10, dome 12 is first fabricated through a manufacturing process including a scooping method that begins with a block of generally solid material, such as sapphire. The manufacturing device utilizes a hardened and sharpened member to scoop out the inside of dome 12 creating concave inner surface 42 to thereby define cavity 58. Similarly, convex outer surface 40 is formed from the same fabrication machine creating the uniform thickness T. Alternatively, when dome 12 is fabricated from ALON, the ALON material is poured, formed, and cured roughly into the shaped of dome 12. Then, as described below, it is polished smooth.

Dome 12 is polished and the surface is finished with a 220 grit fine grind polishing device, however other known polishing devices may be used. In some implementations, it may be more advantageous to polish outer surface 40 and inner surface 42 with higher grit (i.e. more fine) polishing devices. The scooping method of fabrication (i.e., when dome 12 is scooped from sapphire) allows the dome 12 to be formed from a single block of material such that the first hemispherical region 30 has a similar geometry as truncated second hemispherical region 36 and no observable optical hindrance extends between the transverse axis 28 where region 30 meets region 36. Alternatively, the ALON forming method of fabrication (i.e., when dome 12 is formed and cured of ALON) allows the dome 12 to be formed/molded from a uniform source of curable material such that, when cured, the first hemispherical region 30 has a similar geometry as truncated second hemispherical region 36 and no observable optical hindrance extends between the transverse axis 28 where region 30 meets region 36. After fabrication, system 10 may be assembled.

During assembly, module unit 20 is designed and outfitted to carry electro-optical system 18. The electro-optical system 18 may be a camera system or a laser system or any other electro-optical system as one having ordinary skill in the art would understand. The shown embodiments described herein should depict electro-optical system 18 as a laser system carried by a gimbal 84 centered at center 24. A laser output 86 rotates about center 24 on gimbal 84 and can shoot a laser beam 88 across a look angle 56 greater than 180° when viewed in cross-section. Additionally, gimbal 84 may rotate a full 360° about vertical axis 24 when viewed from above as depicted in FIG. 4.

As depicted in FIG. 1, another exemplary advantage of a having a look angle 56 greater than 180° is the ability to fully cover and look for oncoming threats at flying device 22 with only two assembled dome units. Other prior art systems that have less than 180° look angle or even a 180° look angle require at least three units to provide a full scope of coverage for their flying device. Stated otherwise, the system shown in FIG. 1, may include a second replaceable module coupled with the flying device; a second dome base mounted to the second replaceable module; a second unitary infrared (IR) transparent hyper-hemispherical dome having a second look angle greater than 180 degrees, the dome defining an internal cavity, wherein the second dome includes a truncated-hemispherical region extending from a central plane to an arcuate bottom edge, wherein the arcuate bottom edge defines an opening to the cavity; the arcuate bottom edge coupled with the second dome base thereby attaching the second dome to the second dome base; and a second electro-optical system carried by the replaceable module, disposed at least partially, in the internal cavity and adapted to view outward from the flying device at the second look angle to observe oncoming threats; wherein the flying device 22 is visually defended by the two hyper-hemispherical domes and there may be no other unitary IR transparent domes in the system.

Modular unit 20 may be mounted flushly with the outer shell or fuselage of flying device 22 such that base 14 and dome 12 extend slightly outward from fuselage of flying device 22.

In operation, system 10 enables a flying device 22 to observe ground threats 90 such as a missile fired from a ground weapon or an airborne threat 92 such as a missile fired from an enemy aircraft. Electro-optical system 18 scans in 360° about vertical central axis 24 as depicted in FIG. 4 and greater than 180° relative to transverse axis 28 as depicted in FIG. 5. As electro-optical system 18 scans for threats, when a missile or other device is fired from either a ground threat 90 or an airborne threat 92, electro-optical system 18 may initiate laser beam 88 to engage the threat. One exemplary ability of laser beam 88 is to engage an optical eye on the fired projectile from either ground threat 90 or airborne threat 92, thereby jamming the optical system on the projectile and causing the missile to either explode or veer off in a direction away from flying device 22.

Additional examples of domes, dome coatings, dome materials, anti-icing substances, and other aspects of countermeasure systems are described in greater detail in the co-owned patent application No. 14/942,199, and having at least one common inventor, entitled "DOME COATING FOR COUNTERMEASURE ANTI-ICING FUNCTIONALITY" which is filed on the same date as the present application under and is entirely incorporated herein by reference as if fully rewritten.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

What is claimed:

1. A defensive infrared counter measure system comprising: a flying device;

a replaceable module coupled with the flying device; a dome base mounted to the replaceable module;

a unitary infrared (IR) transparent hyper-hemispherical dome having a look angle greater than 180 degrees, the dome defining an internal cavity, wherein the dome includes a truncated-hemispherical region extending from a central plane to an arcuate bottom edge, wherein the arcuate bottom edge defines an opening to the cavity;

the arcuate bottom edge coupled with the dome base thereby attaching the hyper-hemispherical dome to the dome base;

an electro-optical system carried by the replaceable module, disposed at least partially in the internal cavity and adapted to view outward from the flying device at the look angle to observe incoming threats; and a flexure tab on the dome base to flexibly mount the dome base to the replaceable module.

2. The defensive infrared counter measure system of claim 1, further comprising;

a circular rabbet formed in the dome base sized complementary to the arcuate bottom edge; wherein the arcuate bottom edge adjoins the rabbet and a portion of the electro-optical system passes thereby into the internal cavity.

3. The defensive infrared counter measure system of claim 2, further comprising a coupling member securing the dome to the dome base.

4. The defensive infrared counter measure system of claim 3 wherein the coupling member is adhesive having a coefficient of thermal expansion equal to that of the dome and the dome base.

5. The defensive infrared counter measure system of claim 3 wherein the coupling member is annular and L-shaped in cross section, the L-shaped cross section having a first leg extending through the opening to the dome and a second leg extending transversely beneath the rabbet.

6. The defensive infrared counter measure system of claim 5, further comprising an adhesive layer between the coupling member and the base.

7. The defensive infrared counter measure system of claim 1 wherein the dome is formed from a first material and the dome base is formed from a different second material;

a first coefficient of thermal expansion of the first material; and a second coefficient of thermal expansion of the second material equal to the first coefficient.

8. The defensive infrared counter measure system of claim 1 wherein the base defines at least one expansion flexure channel.

9. The defensive infrared counter measure system of claim 1, further comprising:

a second replaceable module coupled with the flying device; a second dome base mounted to the second replaceable module; a second unitary infrared (IR) transparent hyper-hemispherical dome having a second look angle greater than 180 degrees, the dome defining an internal cavity, wherein the second dome includes a truncated-hemispherical region extending from a central plane to an arcuate bottom edge, wherein the arcuate bottom edge defines an opening to the cavity;

the arcuate bottom edge coupled with the second dome base thereby attaching the second dome to the second dome base; and a second electro-optical system carried by the replaceable module, disposed at least partially, in the internal cavity and adapted to view outward from the flying device at the second look angle to observe oncoming threats;

wherein the flying device is visually defended by the two hyper-hemispherical domes and there are no other unitary IR transparent domes in the system.

* * * * *